United States Patent [19]

Watson et al.

[11] 4,068,640

[45] Jan. 17, 1978

[54] COMMON RAIL FUEL INJECTION SYSTEM

[75] Inventors: Edwin B. Watson; Charles V. Brack, both of Sidney, N.Y.

[73] Assignee: The Bendix Corporation, Southfield, Mich.

[21] Appl. No.: 687,830

[22] Filed: May 19, 1976

Related U.S. Application Data

[62] Division of Ser. No. 411,605, Nov. 1, 1975, Pat. No. 3,990,422.

[51] Int. Cl.[2] ..... F02M 39/00

[52] U.S. Cl. ..... 123/139 AT

[58] Field of Search ..... 123/32 EA, 139 E, 139 R, 123/139 AT, 139 AM, 139 AK, 32 G, 140 R, 32 H, 32 AE, 33 J, 139 AG, 139 AL, 139 AP

[56] References Cited

U.S. PATENT DOCUMENTS

| | | | |
|---|---|---|---|
| 2,191,186 | 2/1940 | Amery | 123/140 R |
| 2,886,023 | 5/1959 | Holley, Jr. et al. | 123/139 AT |
| 3,213,886 | 10/1965 | Pearne | 137/625.63 |
| 3,398,730 | 8/1968 | Maddalozzo | 123/139 AL |
| 3,665,907 | 5/1972 | Laufer | 123/139 E |

*Primary Examiner*—Samuel Feinberg
*Attorney, Agent, or Firm*—Raymond J. Eifler

[57] ABSTRACT

An internal combustion engine fuel injection system of the type having a plurality of fuel injection valves which are operated so that continuously pressurized fuel is intermittently supplied to each of the injectors by a distributor. The fuel injection control system further includes a novel flow control circuit for operating each of the fuel injectors, the flow control circuit being a bidirectional flow control circuit which controls the flow of fluid to and from the actuator of the fuel injector. The flow of fluid in one direction through the flow control circuit controls the rate of closing of the fuel injection nozzle while the flow of fluid in the opposite direction through the flow control circuit controls the rate of opening of the fuel injection nozzle.

12 Claims, 17 Drawing Figures

FIG.8
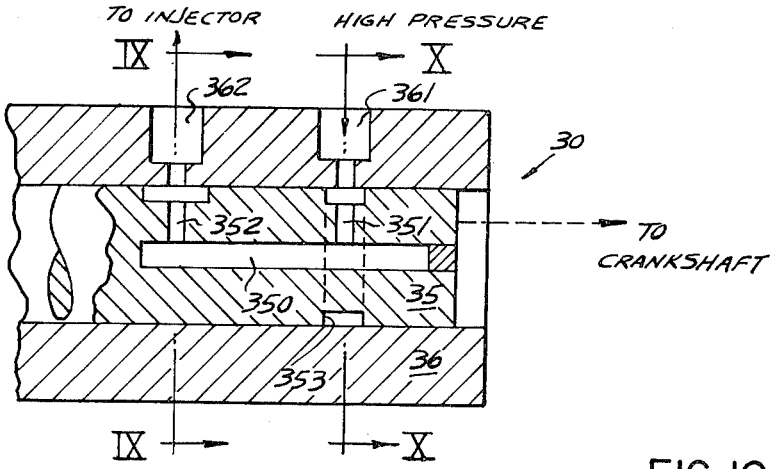
FIG.9
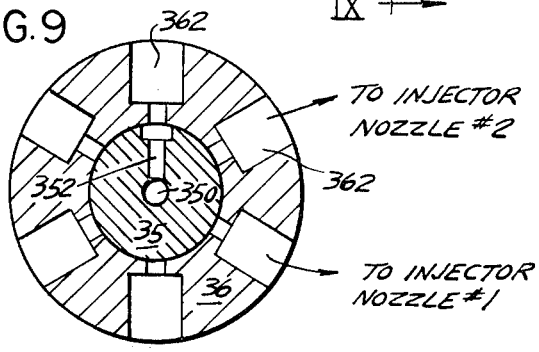
FIG. 10
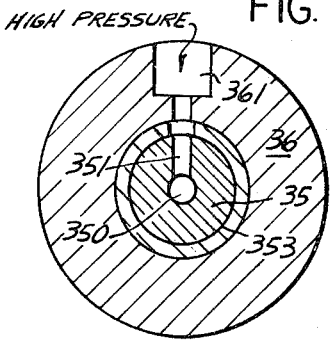
FIG.11
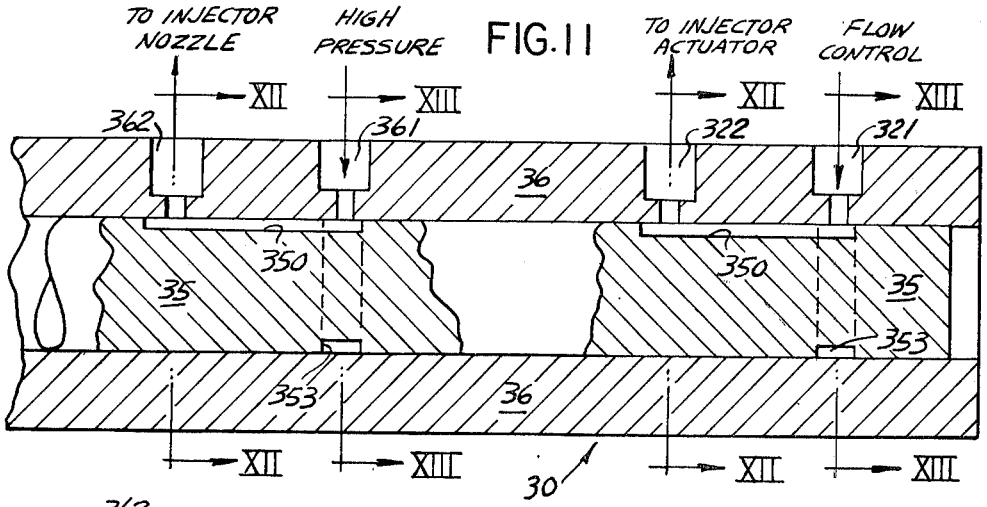
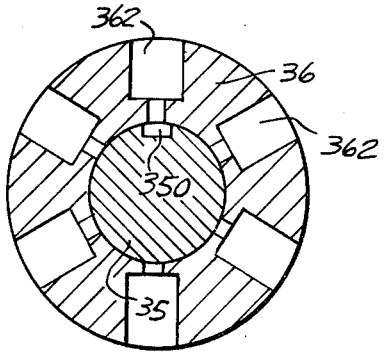
FIG.12
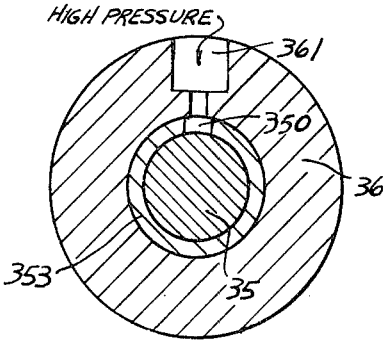
FIG. 13

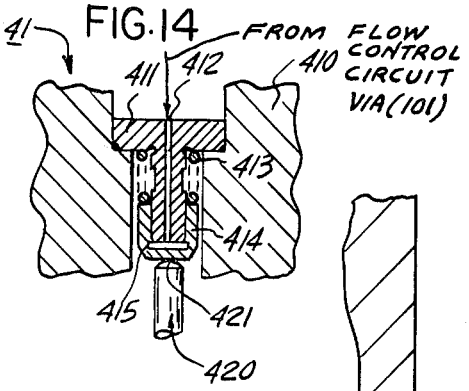
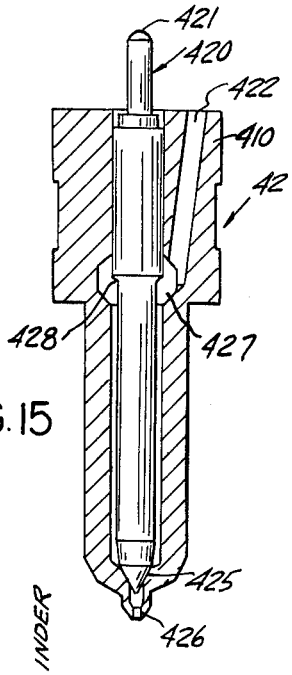
FIG. 15
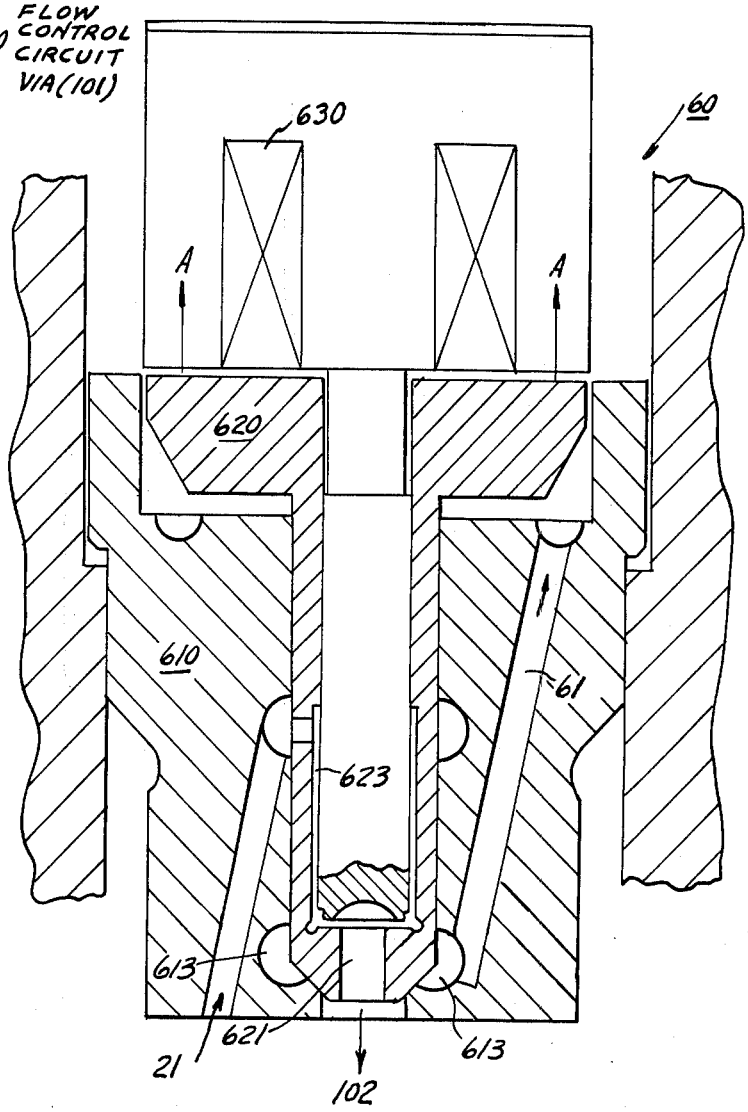
FIG. 16
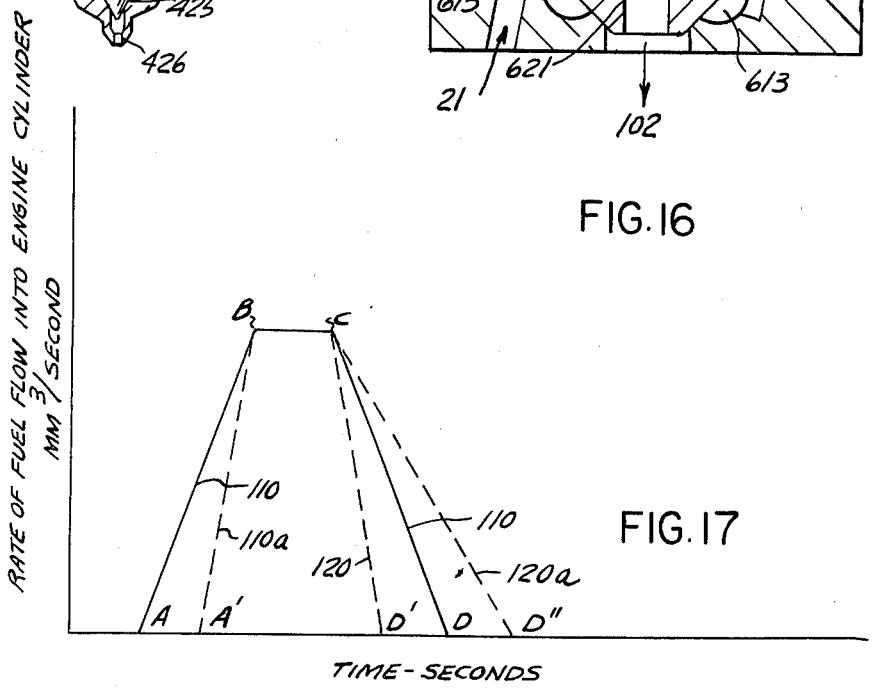
FIG. 17

COMMON RAIL FUEL INJECTION SYSTEM

This is a division, of application Ser. No. 411,605, filed Nov. 1, 1975, U.S. Pat. No. 3,990,422.

BACKGROUND OF THE INVENTION

This invention relates to fuel injection systems for internal combustion engines and to apparatus for use therein.

Diesel fuel injection systems are known in the prior art for injecting fuel to engine cylinders in proper timed relation to the phase of engine operation, and with a duration and quantity of fuel injection appropriate for the particullar engine. However, prior art systems such as that disclosed in U.S. Pat. No. 3,587,547 entitled "Fuel Injection Control System and Apparatus for Use Therein" issued to R. B. Hussey et al., issued June 28, 1971, controlled only the opening of the injector nozzle by limiting, in a flow control circuit, flow of control fluid in only one direction. Therefore, the quantity of fuel injected was only controlled by controlling the duration and rate of opening the injection nozzle. Further, diesel fuel injection systems operate in an environment wherein pressures above 4500 psi and sometimes as high as 10,000 psi are continuously at the fuel injector nozzle. The presence of this high pressure fuel at the injector has been the cause in some instances of injector failure and in other instances leakage of fuel from the injector into the combustion chamber, both undesirable conditions.

SUMMARY OF THE INVENTION

This invention provides a fuel injection control system for an internal combustion engine with the capability of controlling both the opening and closing rate of the injector nozzle and/or providing a unique fuel distribution arrangement that does not continuously supply pressurized fuel to all of a plurality of fuel injectors.

The invention is a fuel injection control system for an internal combustion engine characterized by a flow control circuit (FIG. 7) that limits the flow control both to and from the fuel injector nozzle actuator 41 to control both the opening and the closing of the fuel injector nozzle 42. The fuel injection system may also be characterized by the utilization, in some systems, of two separate pressure sources 10,15 of fuel or fluid, one 15 for supplying pressure to the control portion of the system and the other 10 for supplying pressurized fuel to be injected into the engine. The fuel injection control system may be further characterized by a distributor (FIG. 8 or 11) that distributes the continuously pressurized fuel to the injectors 40 in a predetermined sequence that provides that the pressurized fuel is distributed to only one of the injectors 40 at a time, so that the injectors 40 are not continually subjected to pressurized fluid.

In one embodiment of the invention, a fuel system for an internal combustion engine having a crankshaft and a combustion chamber comprises: a source of fuel 10; a pressurizer 20 for continuously pressurizing the fuel to a first pressure which may be above 4500 psi; a fuel injector 40 connected to the combustion chamber, the fuel injector 40 having an actuator 41 and a nozzle 42 which is opened when the actuator 41 is in a first position and closed when the actuator 41 is in a second position, the nozzle permitting fuel to pass into the combustion chamber 81 when the actuator 41 is in a first position and pressurized fuel 20 is present at the injector 40; a distributor 30 for receiving and distributing the pressurized fuel to the injector 40; control circuitry and apparatus 60,70,100 for controlling the position of the actuator 41 in timed relation to the rotation of the engine crankshaft, the control means including: a source of fluid 15; a pressurizer 25 for pressurizing the fluid to a predetermined pressure; and circuitry and apparatus 100,60,70 for periodically applying the pressurized fluid to the actuator 41 in timed relation to the rotation of the engine and crankshaft 82, the apparatus and circuitry including a flow control circuit 100 which establishes a first rate of flow of pressurized fluid 120 to the actuator 41 to close the nozzle 42 and which establishes a second different rate of flow of fluid 110 from the actuator 41 to open the nozzle 42 whereby the opening and closing of the nozzle is controlled by the flow control circuit 100; an electromagnetic control valve 60 connected between the pressurizer 25 and the flow control circuit 100; and electrical circuitry 70 for operating the electromagnetic control valve 60 to open and close the electromagnetic control valve 60 in timed relation to the rotation of the engine crankshaft 82.

Accordingly, it is an object of this invention to provide a fuel injection control system for internal combustion engine that permits the control of both the opening and closing of the injector nozzle in response to the flow of control fluid to and from the injector actuator.

It is another object of this invention to provide a fuel injection control system for injecting high pressure fuel into a diesel engine or the like that does not continuously apply the highly pressurized fuel to the fuel injectors.

It is still another object of this invention to provide a fuel injection control system that has a continuous fuel pressurizer with a distributor which distributes the pressurized fuel to a plurality of injectors in a predetermined sequence, so that pressurized fuel is not continuously present at the injectors.

It is a further object of this invention to provide a fuel injection control system that has better control over the amount of fuel injected into the engine than prior art fuel injection systems.

It is still a further object of this invention to provide a flow control circuit for a fuel injection control system which restricts the flow of fluid in one direction to control the opening of an injector valve and restricts the flow in a second opposite direction to control the closing of an injector.

It is yet another object of this invention to separate the control valve of a fuel injection system from the nozzle so that heat and vibration from the engine do not effect the operation of the control valve.

It is also an object of this invention to separate the control portion of the injection system from the pressurized fuel portion of the system by utilizing two separate sources of pressurized fluid.

The above and other objects and features of this invention will become apparent from the following detailed description taken in conjunction with the accompanying drawings and claims which form a part of this specification.

BRIEF DESCRIPTION OF THE DRAWINGS

FIG. 8 illustrates a distributor that receives high pressure fuel and delivers it sequentially to a plurality of injectors.

FIG. 9 is a cross-sectional view of the distributor shown in FIG. 8 taken along lines IX—IX.

FIG. 10 is a cross-sectional view of the distributor shown in FIG. 8 taken along line X—X.

FIG. 11 illustrates an alternate type of distributor which separately receives high pressure fuel and a control fluid and delivers them to the injector nozzle and actuator, respectively.

FIG. 12 is a cross-sectional view of the distributor shown in FIG. 11 taken along lines XII—XII.

FIG. 13 is a cross-sectional view of the distributor shown in FIG. 11 taken along lines XIII—XIII.

FIG. 14 is a cross-sectional view of the actuator portion of a fuel injector.

FIG. 15 is a cross-sectional view of the fuel nozzle portion of a fuel injector.

FIG. 16 is a cross-sectional view of an electromagnetic control valve that controls the flow of fluid to an injector actuator.

FIG. 17 is a graphic illustration of the operational characteristics of the flow control circuit shown in FIG. 7.

DETAILED DESCRIPTION OF THE DRAWINGS

Figure 2:
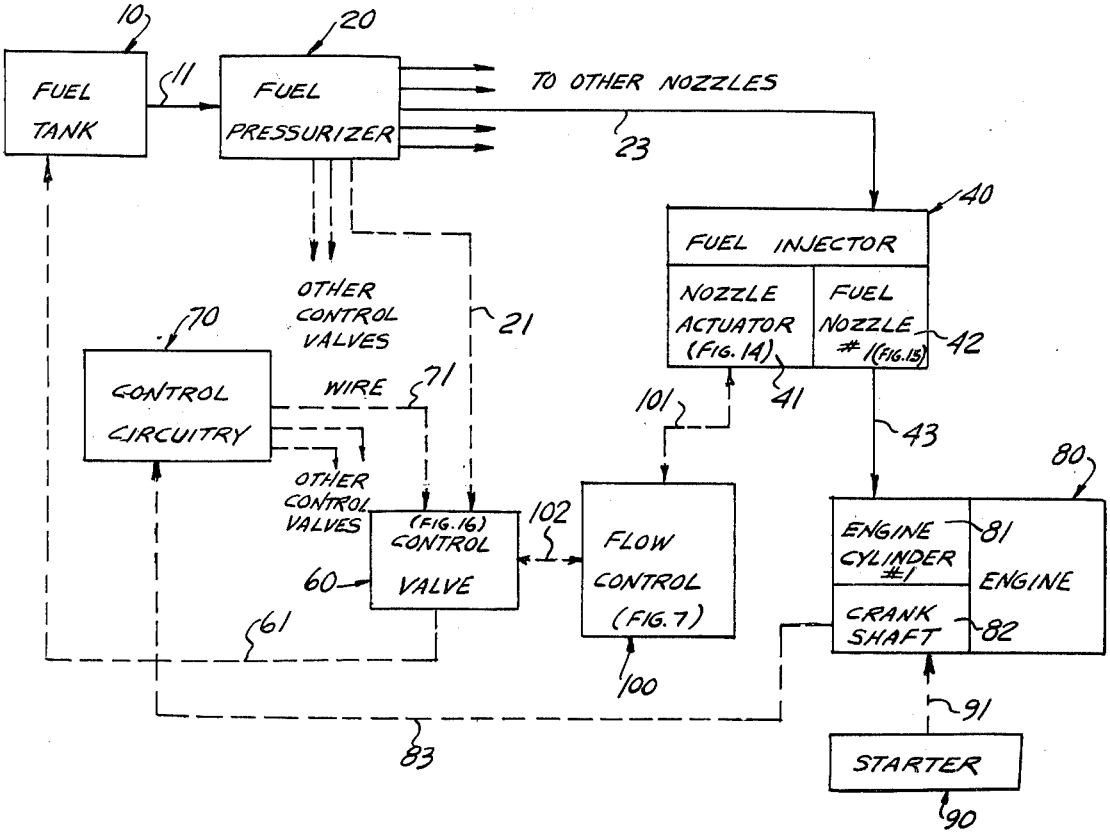
FIG. 2 is a block diagram of another embodiment of the invention that does not utilize a distributor.
Figure 3:
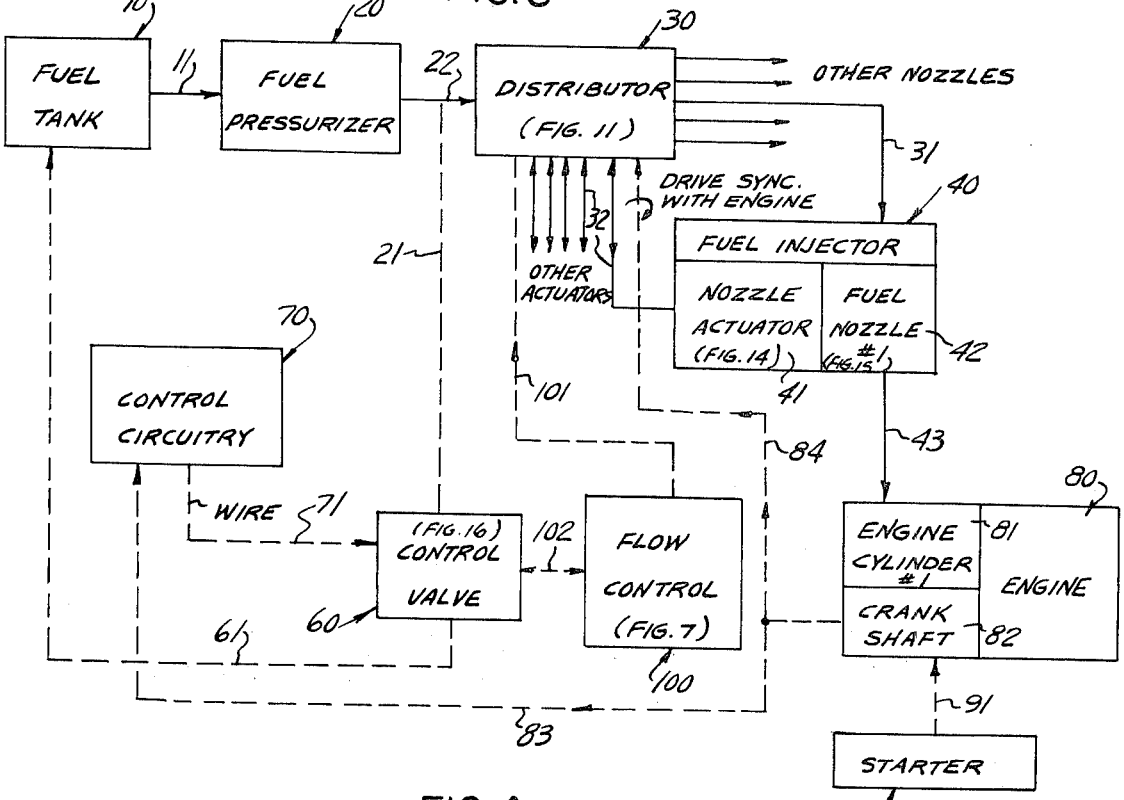
FIG. 3 is a block diagram of another embodiment of the invention which utilizes a flow control circuit and a different distributor than that used in FIG. 1.
Figure 4:
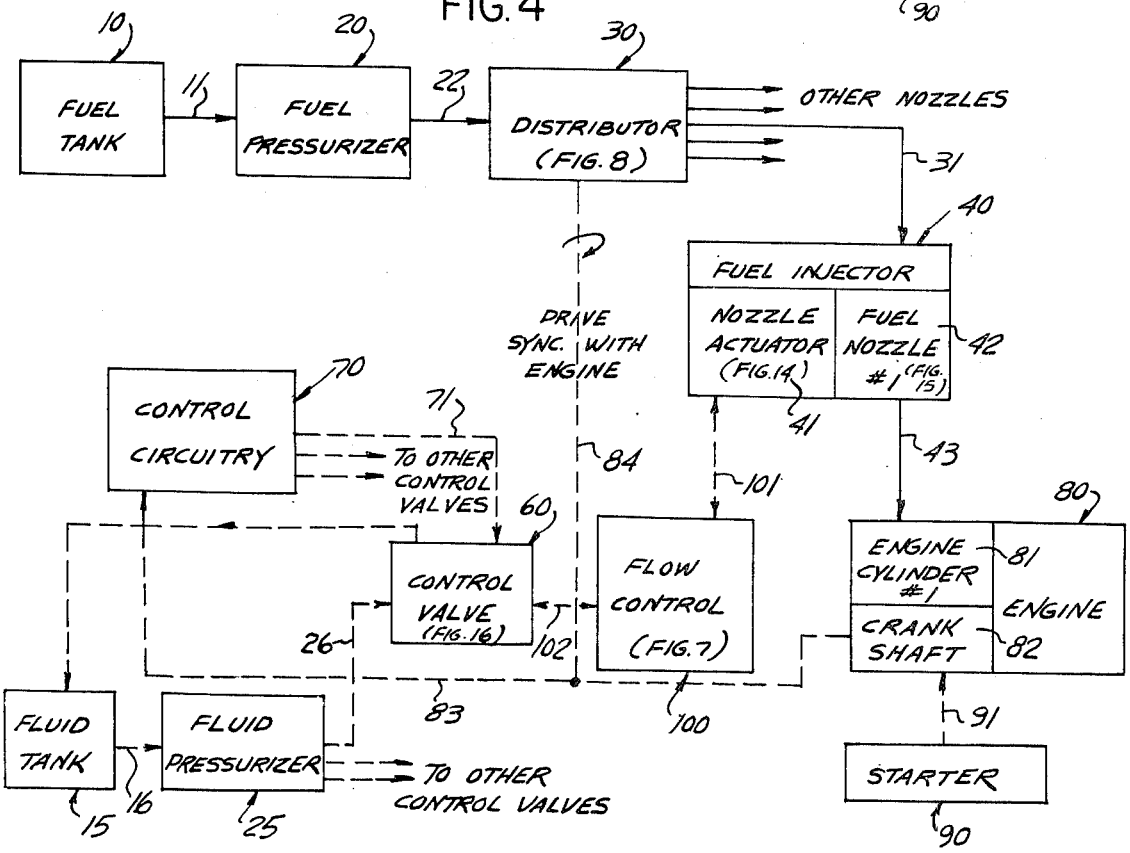
FIG. 4 is a block diagram illustrating another embodiment of the invention similar to that shown in FIG. 1 except that a separate source of control fluid is utilized.
Figure 5:
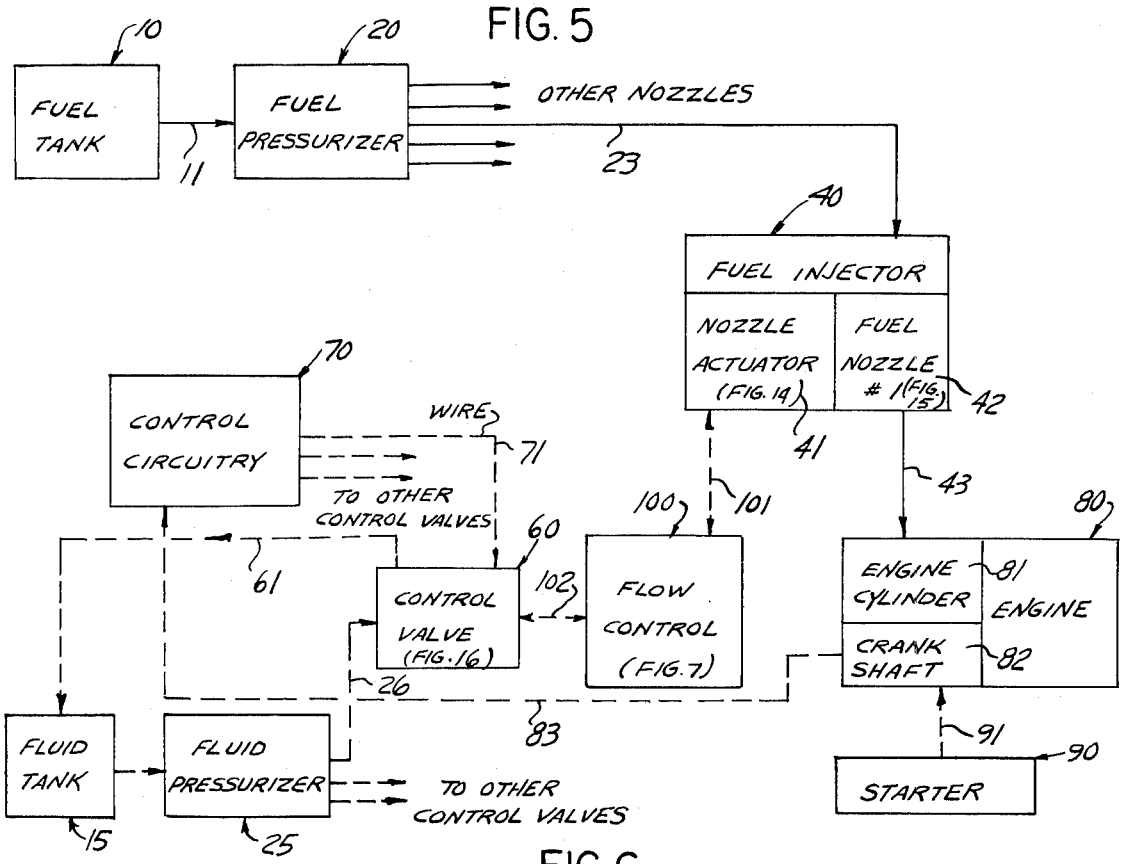
FIG. 5 is a block diagram illustrating another embodiment of the invention similar to that shown in FIG. 4 except that no distributor is required.
Figure 6:
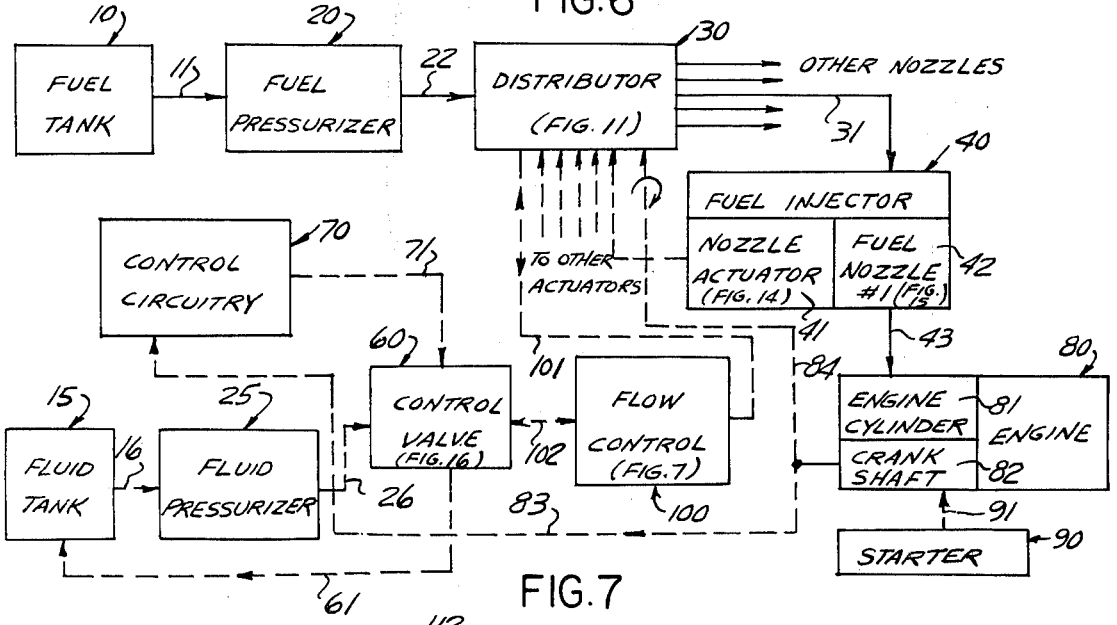
FIG. 6 is a block diagram illustrating another embodiment of the invention similar to that shown in FIG. 4 except that the distributor is of a different type.

Referring now to the drawings, FIGS. 1 through 7 are block diagrams of fuel injection control systems illustrating the objects and advantages of the invention. In each of these figures the flow of fuel may be followed by tracing the solid line from the fuel tank while the control portion of the system may be followed by tracing the dotted lines. FIGS. 1 through 6 all include a flow control circuit 100; FIGS. 4, 5 and 6 have a separate pressurizer 25 for the control portion of the system; and FIGS. 1, 3, 4 and 6 all include a distributor 30 that prevents pressurized fuel from constantly being applied to an injector 40.

Figure 1:
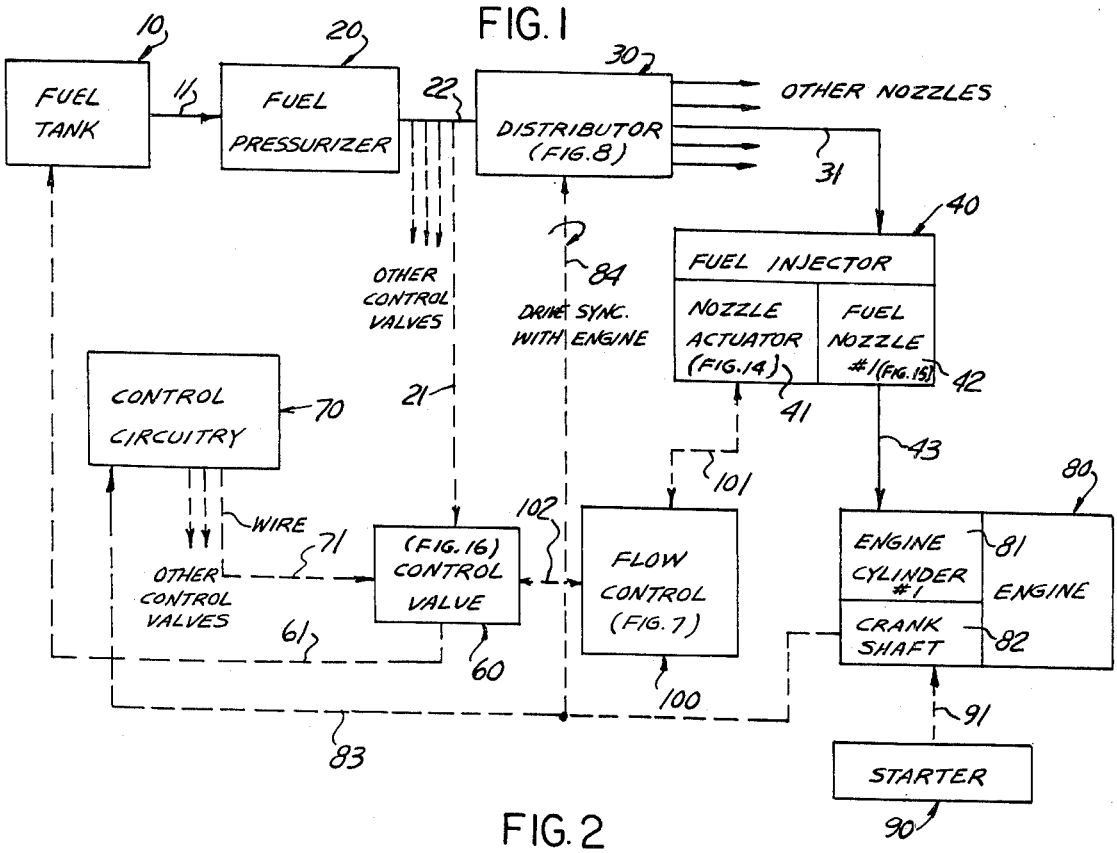
FIG. 1 is a block diagram of one embodiment of the invention that includes a distributor and a flow control circuit in a fuel injection system.

FIG. 1 illustrates a fuel injection control system for an internal combustion engine 80 having an engine cylinder 81, crankshaft 82, and a starter 90 mechanically linked 91 to the engine for starting the engine. The internal combustion engine 80 may be either a rotary type engine or a reciprocating type engine which operates on gasoline or diesel fuel. In a rotary engine instead of engine cylinders 81 there would be a combustion chamber for receiving fuel for combustion to rotate the crankshaft 82. In the preferred embodiment shown the fuel injector system is particularly useful when utilized on a reciprocating type engine requiring highly pressurized diesel fuel (about 10,000 psi) wherein fuel from the fuel tank 10 is injected into one or more engine cylinders 81 by means of a fuel pressurizer 20, a fuel distributor 30 and one or more hydraulically operated fuel injectors 40. Each fuel injector 40 includes a fuel nozzle 42 that is operative to dispense fuel into an engine cylinder 81 and a nozzle actuator 41 which is hydraulically actuated to open and close the fuel nozzle 42 and thereby permit the injector nozzle 42 to dispense fuel into the engine cylinder 81. The distributor 30 receives pressurized fuel from the fuel pressurizer 20 through line 22 and distributes it in a predetermined sequence through fuel lines 31 to respective injectors 40. It is the function of the distributor 30 to periodically apply pressurized fuel to each injector 40, so that pressurized fuel is not constantly present at the injectors. The distributor 30 is linked 84, directly or indirectly, to the engine crankshaft so that the rotation of the distributor is related to the rotation of the engine crankshaft 82. A more detailed description of a distributor 30 preferred for this system may be found in FIGS. 8, 9 and 10. The control portion of this system includes electronic control circuitry 70; control valves 60, linked to the fuel tank 10 by fuel lines 61 and the fuel pressurizer 20 by fuel lines 21; and flow control circuits 100, linked with a respective control valve by fuel line 102 and a respective actuator 41 by fuel line 101. Each control valve 60 is an electromagnetically operated valve, a preferred embodiment of which is illustrated in FIG. 16. It is the function of each control valve 60 to receive pressurized fuel through lines 21 from the pressurizer 20 and distribute the fuel either to a respective flow control circuit 100 through lines 102 or return it to the fuel tank 10 through lines 61. This function is accomplished by the application and removal of electric power to the control valves 60 through electrical lines 71 which is the output of the control circuitry 70. The electronic control circuitry 70 is generally a switching type circuit which senses an operating parameter of the internal combustion engine 80, such as the rotation of the engine crankshaft 82, through a mechanical or electrical linkage 83 to open and close each of the control valves 60 in timed relation to the rotation of the engine crankshaft 82. Two examples of electronic control circuits that are suitable and/or adaptable to this system are described in U.S. Pat. No. 3,526,212 entitled "Electronic Control System for Controlling the Direct or Indirect Fuel Injection in Motors as a Function of Motor Speed" issued Sept. 1, 1970 to J. Bassot et al.; and U.S. Pat. No. 3,653,365 entitled "Electronic Control System for the Injectors of Internal Engines" issued Apr. 4, 1972 to L. A. Monpetit (both hereby expressly incorporated by reference). The flow controls 100 receive pressurized fuel from the control valves 60 through lines 102 and communicates the pressurized fuel to the nozzle actuators 41 through lines 101 to open and close the actuators 41 so that fuel may be injected into each engine cylinder 81 through the fuel nozzles 42. Each flow control circuit 100 controls the rate of fluid flow to each nozzle actuator 41 which in turn controls the rate of closing of a respective nozzle 42. Each flow control circuit 100 also controls the rate of flow from the nozzle actuator 41 which in turns controls the rate of opening of the fuel nozzle 42. A preferred embodiment of a flow control circuit 100 is shown schematically in FIG. 7 and the effect of the flow control circuits 100 over the operational characteristics of the fuel injection system are shown in FIG. 17.

In operation, the injection system illustrated in FIG. 1 operates as follows: When the starter 90 cranks the engine crankshaft 82, the distributor 30, which is in synchronism with the rotation of the engine crankshaft 82, supplies fuel in a predetermined sequence to the nozzles 42 of each fuel injector 40. Simultaneously, the control circuit 70 which is also keyed to the rotation of the engine crankshaft 82, is energizing the control valves 60 to periodically apply a control fluid (pressurized fluel) to the nozzle actuators 41 through the flow control circuits 100 in synchronism with the application of pressurized fuel to the injectors 40 from the distributor 30. The application of pressurized fluid (fuel) to the nozzle actuator 41 opens and closes the fuel nozzle 42 allowing pressurized fuel distributed to each of the injectors 40 through lines 31 to be dispensed into an appropriate engine cylinder 81. It is to be understood that the distributor 30 applies pressurized fuel to each fuel injector 40 for a predetermined duration which is greater than the duration which the control valves 60 apply pressurized fuel to one of the nozzle actuators 41. Since the distributor 30 and the control circuitry 70 are both synchronized to the rotation of the engine crankshaft 82, all of the control valves 60 will energize an appropriate fuel injector nozzle actuator 41 when pressurized fuel from lines 31 is present at a respective injector nozzle 42.

FIG. 2 illustrates a fuel injection control system similar to that described in FIG. 1 except that it does not include a distributor. In this embodiment, fuel from the fuel pressurizer 20 is distributed to each of the fuel injectors 40 through lines 23. The control portion of this system is the same as that shown in FIG. 1 and includes a control valve 60 and a flow control circuit 100 for each fuel injector 40.

In operation, the injection system illustrated in FIG. 2 operates substantially the same as that shown in FIG. 1 except for the fact that fuel from the pressurizer 20 does not pass through a distributor (FIG. 1, 30) so that pressurized fuel is constantly present at each of the injector nozzles 42.

FIG. 3 illustrates a fuel injection control system similar to that shown in FIG. 1 except that this system only requires one control valve 60; one flow control 100 and a distributor 30 of the type shown in FIG. 11. Both the control valve 60 and the flow control 100 are the same as that used in the system shown in FIG. 1. However, the distributor 30 is of the type shown in FIG. 11 and is capable of receiving a pressurized fuel and distributing it to each of the injectors 40 while separately receiving the same or other pressurized fuel and distributing it to each of the nozzle actuators 41 through distribution lines 32. The use of this type of distributor 30 eliminates the need for having the same number of control valves 60 and flow controls 100 as there are fuel injectors 40.

In operation, the injection system illustrated in FIG. 3 operates substantially the same as that described for FIG. 1 except for the fact that the distributor 30 distributes both pressurized fuel to the fuel nozzle 42 and a lower pressurized fuel to the nozzle actuator 41. Both the distributor 30 and the control circuitry 70 are linked to the engine crankshaft so that they operate in synchronism to supply fuel to the engine at the proper time.

FIG. 4 illustrates a fuel injection control system similar to that shown in FIG. 1 except that the pressurized fluid supplied to the control valve 60 is supplied not from the fuel tank 10 but from a separate source of fluid 15 and a separate fluid pressurizer 25. The distributor 30 which distributes pressurized fuel to each of the injectors 40 is the same as that utilized in the system shown in FIG. 1 and illustrated in FIG. 8. The control portion of this injection system includes a plurality of control valves 60 and flow controls 100 equal to the number of fuel injectors 40. Each of the electromagnetically operated control valves 60 receiving a control signal from the control circuitry 70 through electrical lines 71 and pressurized fluid from fluid pressurizer 25 from fluid lines 26.

In operation, the injection system illustrated in FIG. 4 operates substantially the same as that described in FIG. 1 except for the fact that the control valves 60 receive pressurized fluid from a fluid pressurizer 25 which is separate from the fuel pressurizer 20.

FIG. 5 illustrates a fuel injection control system similar to that shown in FIG. 2. In this embodiment of the fuel injection control system, a distributor, which prevents pressurized fuel from constantly being applied to the injectors 40, is not utilized and a source of pressurized fluid 15,25 separate from the pressurized fuel source 10,20 is utilized.

In operation, the fuel injection control system illustrated in FIG. 5 operates substantially the same as the system shown in FIG. 2 except for the control portion of the system which, in this instance, receives pressurized fluid from a source of fluid 15 separate from the fuel tank 10.

FIG. 6 illustrates a fuel injection control system similar to that shown in FIG. 3 except that this system includes a source of pressurized fluid 25, separate from the pressurized fuel 20, for operating the nozzle actuators 41. In this system, like the system described in FIG. 3, the distributor is of the type shown in FIG. 11, which requires the use of only control valve 60 and one flow control 100.

In operation, the system described in FIG. 6 operates substantially the same as that described in FIG. 3 except that the nozzle actuator 41, flow control 100 and control valve 60 receive pressurized fluid from a source isolated and separate from the fuel pressurizer 20.

Figure 7:
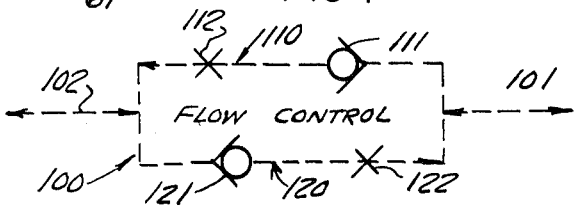
FIG. 7 is a schematic diagram of a flow control circuit which accomplishes an object of this invention.

FIG. 7 illustrates schematically a flow control circuit 100 utilized in the fuel injection systems shown in FIGS. 1 through 6. The flow control circuit 100 is bidirectional in that, pressurized fluid or pressurized fuel flow in opposite directions may be controlled to flow at different rates to control the desired opening and closing rates of the fuel nozzle and hence the quantity of fuel injected into an engine. The flow control circuit 100 includes an input passage 102 and an output passage 101 connected together by a first flow path 110 and a second parallel flow path 120. The first flow path 110 has a restriction therein 112 sized to pass fluid at a particular flow rate therethrough and a check valve 111 to permit the flow of pressurized fluid through the restriction 112 to flow in only one direction. In the embodiment shown, the check valve 111 prevents fluid from flowing from the input passage 102 to the output passage 101 but allows fluid to flow from the output passage 101 to the input passage to and out of the input passage 102. The second flow path includes a restriction 122 sized to control the rate flow of fluid at a predetermined rate, which is generally different than the rate of flow through the first restriction 112, and a check valve 121 which permits fluid to flow through the second flow path 120 in only one direction, which is opposite from the direction of the fluid flowing through said first flow path 110.

In view of the fact that the rate of flow in each direction through the flow control circuit 100 controls the rate of closing of the fuel nozzle 42, the rate of fuel and the quantity of fuel injected into the engine 80 may be more closely controlled. The control of the flow control circuit 100 over the quantity of fuel injected to the engine is readily illustrated in FIG. 17 and the accompanying explanation therewith which is described hereinafter.

FIGS. 8, 9 and 10 illustrate a distributor 30 of the type preferred for use in the systems illustrated in FIGS. 1 and 4.

FIG. 8 illustrates a distributor 30 having a housing 36 and a member 35 rotatably mounted within the housing which is mechanically linked, in an appropriate manner, to an engine crankshaft (not shown). The housing 36 includes an inlet passage 361 for receiving pressurized fuel from a fuel pressurizer (FIG. 1, 20), and a plurality of outlet passages 362 which permit the passage of fuel to injectors through appropriate fuel lines (FIG. 1, 31). The member 35, which is rotatably mounted within the housing 36, includes a central passage 350 which connects together an inlet passage 351 to an outlet passage 352. The internal inlet passage 352 of the rotatable member 35 is spaced to communicate with the housing inlet passages 361,362 respectively. The internal inlet passage 351 communicates with an annular groove 353 in the member 35 so that the internal inlet passage 351 is in constant communication with the pressurized fluid that enters the housing inlet 361.

FIG. 9 is a cros-sectional view of the distributor 30 shown in FIG. 8 taken along lines IX—IX. The cross-sectional view illustrates the plurality of housing outlet passages 362 and how they are isolated one from another so that pressurized fluid in the outlet passage 352 or the rotatable member 35 is not continuously communicating with all of the housing outlet passages 362. In the position illustrated, the rotatable member 35 is communicating pressurized fluid through its outlet 352 only through the uppermost housing outlet 362. Although there are six outlet passages 362 shown, it is to be understood that there may be as many or as few outlet passages 362 as there are injector nozzles associated with an engine. This particular distributor 30 would be useful in distributing fuel to the six injector nozzles of a six cylinder engine.

FIG. 10 illustrates a cross-sectional view of the distributor 30 shown in FIG. 8 taken along lines X—X. This particular cross-sectional view illustrates very well that no matter what the position of the internal inlet passage 351 is with respect to the housing inlet passage 361, there is a communicating link between the two inlet passages 361 and 351 because of the annular groove 353 in the rotatable member 35.

In operation, the distributor 30 shown in FIGS. 8, 9 and 10 operates as follows: High pressure fuel enters the housing inlet passage 361 and is communicated to the central passage 350 of rotatable member 35 through the internal inlet passage 351 and the annular groove 353. As the member 35 rotates, pressurized fuel at the rotating member outlet 352 is supplied sequentially and intermittently to each of the housing outlets 362 where the pressurized fluid then flows to an injector nozzle. It can be readily appreciated from these views that when the internal outlet passage 352 is between the housing outlet passages 362, that no fuel will be dispensed through any of the housing outlets 362.

FIGS. 11, 12 and 13 illustrate a distributor 30 of the type that is preferred for use in the fuel injection systems illustrated in FIGS. 3 and 6.

FIG. 11 illustrates a distributor 30 that is capable of separately receiving high pressure fuel to be transmitted to injector nozzles and pressurized fluid or fuel to be transmitted to injector actuators. The distributor 30 includes a housing 36 and a member 35 which is rotatably mounted within the housing 36 and which is mechanically linked, in an appropriate manner, to an engine crankshaft (not shown). The housing 36 includes a first inlet passage 361 for receiving pressurized fuel from a fuel pressurizer (FIG. 3, 20); and a plurality of first outlet passages 362 which permit the passage of fuel to injectors through appropriate fuel lines (FIG. 3, 31). The housing 36 also includes a second inlet passage 321 for receiving pressurized fuel or fluid from a pressurizer (FIG. 3, 20 or FIG. 6, 25) and a plurality of second outlet passages 322 which permit the passage of fuel or fluid to the injector actuators through appropriate lines (FIG. 3, 22). The member 35, which is rotatably mounted within the housing 36 includes a first axial groove 350 along the periphery of the member 35 and a first annular groove 353 around the periphery of the member 35 which communicates with the axial groove 350 and inlet 361. The axial groove 350 in the position shown connects the housing first inlet passage 361 to the housing second outlet passage 362. An identical arrangement of a second axial groove 350 and a second annular groove 353 are spaced from the first grooves 350,353 to communicate the housing second inlet 321 and second outlet 322.

FIG. 12 is a cross-sectional view of the distributor 30 shown in FIG. 11 taken along lines XII—XII. This cross-sectional view illustrates the plurality of housing outlet passages 362 and how they are isolated one from another so that pressurized fluid in the axial groove 350 of the rotatable member 35 is not continuously communicating with all of the housing outlet passages 362 simultaneously. In the position illustrated, the rotatable member 35 is communicating pressurized fluid only through the uppermost housing outlet 362. Although there are six outlet passages 362 show, it is to be understood that there may be as many or as few passages 362 as there are injector nozzles associated with an engine. This particular distributor 30 would be used for distributing fuel to the six injector nozzles of a six cylinder engine.

FIG. 13 illustrates a cross-sectional view of the distributor 30 shown in FIG. 11 taken along lines XIII—XIII. This particular cross-sectional view illustrates how the housing inlet passages 361 and 321 communicate with the annular groove 353 and the axial groove 350 in the rotatable member 35.

In operation, the distributor 30 shown in FIGS. 11, 12 and 13 operates as follows: High pressure fuel enters the housing inlet passage 361 and is communicated to the axial passage 350 of the rotatable member 35. As the member 35 rotates, pressurized fuel in the axial groove 350 of the rotating member 35 is supplied sequentially and intermittently to each of the housing outlets 362. The pressurized fuel then flows to an injector nozzle. Similarly and simultaneously, pressurized fuel or fluid is entering the second housing inlet passage 321 and is communicated to the other axial groove 350 of the rotatable member 35. As the member 35 rotates, pressurized fluid or fuel is supplied sequentially and intermittently to each of the housing second outlets 322 where the pressurized fluid or fuel then flows to an injector actuator. It can be readily appreciated from these views that when the axial groove 350 in the rotating member 35 is between the housing outlet passages 362 or 322 that no fuel or fluid will be dispensed through any of the housing outlets 362,322.

FIG. 14 is a partial diagrammatic view of the nozzle actuator 41 portion of a fuel injector. The nozzle actuator 41 includes a housing 410 that has mounted therein a body 411 that has a central passage 412 for receiving pressurized fluid. Mounted around a portion of the body 411 is a cap 414 that is biased by a spring 413 that forces the cap against one end 421 of a nozzle valve stem 420 and forms cavity 415 that is connected to passage 412.

FIG. 15 illustrates the fuel nozzle 42 portion of a fuel injector. The fuel nozzle 42 portion includes a housing 410; a central passage in the housing 410 having mounted therein a valve stem 420, one end 421 of the valve stem 420 being actuated by movement of the cap 415 of the actuator 41 shown in FIG. 14, the other end 425 of the valve stem 420 being seated in one end of the central passage to block the central passage opening 426; and a second passage 422 that receives pressurized fuel from a fuel pressurizer 20 or distributor 30 through line 23 or 31 as shown in FIGS. 2 and 1 respectively.

Referring now to FIGS. 14, 15 and 1 through 6, the fuel injector nozzle 42 and actuator 41 operate as follows: The valve stem 420 of the nozzle 42 which is in the normally closed position, blocks the nozzle opening 426 during the presence of pressurized fluid in passage 412 which, in combination with the spring 413 holds cap 414 against one end 421 of the valve stem 420. When pressurized fuel enters or is applied to passage 422 from fuel lines 3 or 31), fuel in the central passage 427 around the valve stem 420 applies a force against the differential portion 428 of the valve stem 420 in a direction away from the nozzle opening 426. However, this force exerted against the valve stem 420 is insufficient to overcome the force of the spring 413 and pressurized fluid in the cavity 415 acting in the opposite direction against the valve stem 420 and therefore the central passage opening remains closed. But, when pressure is removed from the passage 412 of the actuator 41, the pressure in passages 422 and 427 is sufficient to move the valve stem 420 in a direction that unblocks the opening 426 and allows fuel to flow from the injector nozzle 42 into an engine cylinder 81. As previously discussed in the description of the systems shown in FIGS. 1 through 6 and the distributors illustrated in FIGS. 8 through 13, pressure is removed from the fluid or fuel in passage 412 of the actuator 41 by action of either the rotating distributor 30 or the electromagnetically operated control valve 60.

FIG. 16 illustrates a cross-sectional view of a control valve 60 of the type that is preferred for use in the fuel injection systems illustrated in FIGS. 1 through 6. The control valve 60 includes: an electromagnetic coil 630, connected to control circuitry (70, FIG. 1) through wires 71; an inlet passage 21 that receives pressurized fuel from a pressurizer; a spill passage 61 which supplies a return passage to a fuel tank; and an outlet passage 102 that supplies pressurized fuel to a flow control circuit (FIG. 7).

In operation, the control valve 60 operates as follows: When the electromagnetic coil 630 is de-energized, the assemblies 610,620 provide a path from the input passage 21 through internal passages 623,621 to the outlet passage 102 and hence flow control circuit 100. When magnetic coil 630 is energized, the assembly 620 moves away from stationary assembly portion 610 in the direction of the arrow "A" and provides a return path to the fuel tank 10 through passages 613 and 61.

FIG. 17 illustrates graphically how the quantity of fuel injected into an engine cylinder can be controlled by the flow circuit 100 shown in FIG. 7. Lines AB and A'B illustrate the rate of fuel flow into the engine cylinder at the beginning of injection when the fuel injector nozzle 42 is first opened. Line BC illustrates the constant rate of fuel flow into an engine cylinder when the fuel injector nozzle is open. Lines CD, CD' and CD" illustrate the rate of fuel flow in an engine cylinder at the end of injection when the fuel nozzle 42 is closed.

At this point it is appropriate to note that prior art flow control circuits are different than that disclosed in FIG. 7 because they were limited to only one flow path and one restriction restricting the flow rate in both directions. Because the flow rate was fixed in one direction in prior art systems, the flow rate in the opposite direction was also fixed. Therefore, in prior art systems the control over the amount of fuel injected into an engine cylinder at the beginning of injection limited what could be done with respect to the amount of fuel injected into the engine at the end of the injection time. Such is not the case in applicants' flow circuit shown in FIG. 7 wherein the rate of flow in one direction is independent of the rate of flow in the other direction because different flow paths (110,120 and restrictions 112,122 are provided for the flow of fluid in each direction.

Referring now to FIGS. 7 and 17, the advantages of applicants' invention should now become more readily apparent. The restrictions 112,122 and the check valves 111,121 may be designed to produce a rate of flow of fuel into an engine cylinder (A', B or AB) during the beginning of injection and another rate of fuel flow into the engine cylinder (CD, CD', CD") at the end of injection by merely sizing the restrictions 112 and 122 to obtain the desired result. For example, the restriction 112 in the flow control circuit 100 may be sized to obtain the flow rates shown by AB, or A'B. Similarly, the restriction 122 of the flow control circuit may also be sized, by design, to obtain a flow rate which is not dependent on restriction 112 illustrated by lines CD, CD' or CD". Obviously, since both the opening and closing rate of the injector nozzle can be controlled, greater control over the quantity of fuel injected into the engine and the manner in which the fuel injected into the engine can be obtained.

While a preferred embodiment of the invention has been disclosed, it will be apparent to those skilled in the art that changes may be made in the invention as set forth in the appended claims, and, in some instances, certain features of the invention may be used to advantage without corresponding use of other features. Accordingly, it is intended that the illustrative and descriptive materials herein be used to illustrate the principles of the invention and not to limit the scope thereof.

Having described the invention what is claimed is:

1. A fuel system for an engine having a crankshaft and a combustion chamber, comprising:

means for continuously pressurizing fuel to a first predetermined pressure;

a fuel injector connected to said combustion chamber, said injector having an actuator and a nozzle which is opened when said actuator is in a first position and closed when said actuator is in a second position, said nozzle permitting fuel from the pressurizer to pass into said combustion chamber when said actuator is in said first position and pressurized fuel is present at said injector;

means for receiving and periodically distributing said pressurized fuel to said injector;

means for controlling the position of said actuator in timed relation to the rotation of said engine crankshaft, said control means including:

a flow control circuit which establishes a first rate of flow of pressurized fuel to said actuator to close said nozzle and which establishes a second different rate of flow of fuel from said actuator to open said nozzle, whereby the rate of opening and closing of said nozzle is controlled by said flow control circuit;

an electromagnetic control valve means connected between said means for pressurizing said fuel and said flow control circuit; and electrical circuit means for operating said electromagnetic valve means to open and close said electromagnetic control valve means in timed relation to the rotation of said engine crankshaft, whereby fuel is periodically injected into said combustion chamber in timed relation to the rotation of said engine crankshaft.

2. The fuel system as recited in claim 1 wherein the flow control circuit of said applying means includes a first flow path having a restriction therein and a check valve to permit the flow of pressurized fluid through said restriction to flow in only one direction and a second flow path having a restriction therein and a check valve which permits fuel to flow through said second flow path in only a second opposite direction from the fuel flowing through said first flow path.

3. A fuel system for an engine having a crankshaft and a plurality of cylinders, comprising:

means for continuously pressurizing said fuel to a first predetermined pressure;

a plurality of fuel injectors, each connected to a respective cylinder, each injector having an actuator and a nozzle which is opened when said actuator is in a first position and closed when said actuator is in a second position, each of said nozzles permitting fuel to pass into a respective cylinder when said actuator is in said first position and pressurized fuel is present at said injector;

means for receiving and distributing said pressurized fuel to said injectors in a predetermined sequence that provides that said pressurized fuel is distributed to only one of said injectors at a time, whereby said injectors are not continually subjected to said pressurized fuel; and means for controlling the position of said actuators in timed relation to the rotation of said engine crankshaft, said control means including:

a flow control circuit which establishes a first rate of flow of pressurized fuel going to said actuator to close said nozzle and which establishes a second different rate of flow of fuel coming from said actuator to open said nozzle, whereby the rate of opening and closing of said nozzle is controlled by said flow control circuit;

electromagnetic control valve means connected between said means for pressurizing said fuel and said flow control circuit; and electrical circuit means for periodically opening and closing said electromagnetic control valve means in timed relation to the rotation of said engine crankshaft, whereby fuel is periodically injected into an engine cylinder in timed relation to the rotation of said engine crankshaft.

4. The fuel system as recited in claim 3 wherein the flow control circuit includes a first flow path having a restriction therein and a check valve to permit the flow of pressurized fuel through said restriction to flow in only one direction and a second flow path having a restriction therein and a check valve which permits fuel to flow through said second flow path in only a second opposite direction from the fuel flowing through said first flow path.

5. A fuel system for an internal combustion engine having a crankshaft and a combustion chamber, comprising:

means for pressuzing fuel to a first predetermined pressure;

a fuel injector adapted to receive said fuel, said injector connected to said combustion chamber, said injector having an actuator and a nozzle which is opened when said actuator is in a first position and closed when said actuator is in a second position, said nozzle permitting fuel to pass into a cylinder when said actuator is in said first position and pressurized fuel is present at said injector;

means for controlling the positioning of the actuator in timed relation to the rotation of said engine crankshaft, said control means including:

a flow control circuit which establishes a first rate of flow of pressurized fuel going to said actuator to close said nozzle and which establishes a second opposite rate of flow of fluid, independent of said first flow rate, from said actuator to open said nozzle, whereby the opening and closing of said nozzle is controlled by said flow control circuit;

an electromagnetic control valve means connected between said means for pressurizing said fuel and said flow control circuit; and electrical circuit means for operating said electromagnetic control valve means to open and close each of said electromagnetic valve means in timed relation to the rotation of said engine crankshaft, whereby fuel is periodically injected into an engine cylinder in timed relation to the rotation of said engine crankshaft.

6. The fuel system as recited in claim 5 wherein the flow control circuit includes a first flow path having a restriction therein and a check valve to permit the flow of pressurized fuel through said restriction to flow in only one direction and a second flow path having a restriction therein and a check valve which permits fuel to flow through said second flow path in only a second opposite direction from the fuel flowing through said first flow path.

7. A fuel system for an internal combustion engine having a crankshaft and a combustion chamber comprising:

a source of fuel;

means for continuously pressurizing said fuel to a first predetermined pressure;

a fuel injector connected to said combustion chamber, said injector having an actuator and a nozzle which is opened when said actuator is in a first position and closed when said actuator is in a second position, said nozzle permitting fuel to pass into said combustion chamber when said actuator is in said first position and pressurized fuel is present at said injector;

means for receiving fuel from said fuel pressurizing means and distributing fuel to said injector nozzle in timed relation to the rotation of said engine crankshaft, said means including separate input means for receiving pressurized fuel from another portion of said fuel system and distributing said fuel to said injector actuator; and means for controlling the position of said actuator in timed relation to the rotation of said engine crankshaft, said means including:

a flow control circuit which establishes a first rate of flow of pressurized fuel going to said actuator through said distributing means input to close said nozzle and which establishes a second opposite rate of flow of fuel independent of said first flow rate from said distributing means and said actuator to open said nozzle, whereby the opening and closing of said nozzle is controlled by said flow control circuit and said actuator;

electromagnetic valve means connected between said means for pressurizing said fuel and said flow control circuit; and electrical circuit means for operating said electromagnetic valve means to open and close said electromagnetic valve means in timed relation to the rotation of said engine crankshaft.

8. A fuel system for an engine having a crankshaft and a plurality of cylinders comprising:

a source of fuel;

means for continuously pressurizing said fuel to a first predetermined pressure;

a plurality of fuel injectors, each connected to a respective cylinder, each injector having an actuator and a nozzle which is opened when said actuator is in a first position and closed when said actuator is in a second position, each of said nozzles permitting fuel to pass into a respective cylinder when said actuator is in said first position and pressurized fuel is present at said injector;

means for receiving fuel from said pressurizing means and distributing said pressurized fuel to said injector nozzles in timed relation to the rotation of the engine crankshaft and in a predetermined sequence that provides that said pressurized fuel is distributed to only one of said injector nozzles at a time, whereby said injectors are not continually subjected to said pressurized fuel, said means including separate input means for receiving pressurized fuel from another portion of said fuel system and distributing said fuel to said injector actuators;

means for controlling the positioning of the actuators in timed relation to the rotation of said engine crankshaft, said means including:

a flow control circuit which establishes a first rate of flow of pressurized fuel to said actuators through said distributing means input to close said nozzles and which establishes a second opposite rate of flow of fuel independent of said first flow rate from said distributing means and actuators to open said nozzles, whereby the opening and closing of said nozzles is controlled by said flow control circuit;

electromagnetic valve means connected between said means for pressurizing said fuel and said flow control circuit; and electrical circuit means for operating said electromagnetic valve means to open and close said electromagnetic valve means in timed relation to the rotation of said engine crankshaft.

9. A fuel system for an internal combustion engine having a crankshaft and a combustion chamber, comprising:

a source of fuel;

means for pressurizing said fuel to a first predetermined pressure;

a fuel injector connected to said combustion chamber, said injector having an actuator and a nozzle which is opened when said actuator is in a first position and closed when said actuator is in a second position, said nozzle adapted to receive fuel from said pressurizing means and permit fuel to pass into said combustion chamber when said actuator is in said first position and pressurized fuel is present at said injector;

means for controlling the position of the actuator in timed relation to the rotation of said engine crankshaft, said means including:

a source of fluid;

means for pressurizing said fluid to a predetermined pressure;

a flow control circuit which establishes a first rate of flow of pressurized fluid to said actuator to close said nozzle and which establishes a second opposite rate of flow of fluid independent of said first flow rate from said actuator to open said nozzle, whereby the speed at which said valve is opened and closed is controlled by said flow control circuit;

an electromagnetic valve means connected between said means for pressurizing said fluid and said flow control circuit; and electrical circuit means for operating said electromagnetic valve means to open and close said electromagnetic valve means in timed relation to the rotation of said engine crankshaft.

10. The fuel system as recited in claim 9 wherein the flow control circuit includes a first flow path having a restriction therein and a check valve to permit the flow of pressurized fluid through said restriction to flow in only one direction and a second flow path having a restriction therein and a check valve which permits fluid to flow through said second flow path in only a second opposite direction from the fluid flowing through said first flow path.

11. A fuel system for an engine having a crankshaft and a combustion chamber, comprising:

a source of fuel;

means for pressurizing said fuel to a first predetermined pressure;

a fuel injector connected to said combustion chamber, said injector having an actuator and a nozzle which is opened when said actuator is in a first position and closed when said actuator is in a second position, said nozzle permitting fuel to pass into said combustion chamber when said acuator is in said first position and pressurized fuel is present at said injector;

means for receiving fuel from said pressurizing means and distributing said pressurized fuel to said injector nozzle in timed relation to the rotation of said engine crankshaft, said means including input means for receiving fluid from another part of said fuel system and distributing such fluid to said injector actuator valves; and means for controlling the position of said actuator in timed relation to the rotation of said engine crankshaft, said control means including:

a source of fluid;

means for pressurizing said fluid to a predetermined pressure;

a flow control circuit which establishes a first rate of flow of pressurized fluid to said actuator valve through said distributor input means to close said nozzle and which establishes a second opposite rate of flow of fluid independent of said first flow rate, from said distributing means and said actuator valve to open said nozzle, whereby the opening and closing of said nozzle is controlled by said flow control circuit;

electromagnetic valve means connected in series between said means for pressurizing said fluid and said flow control circuit; and electrical circuit means for periodically opening and closing said electromagnetic valve means in timed relation to the rotation of said engine crankshaft.

12. The fuel system as recited in claim 11 wherein the flow control circuit includes a first flow path having a restriction therein and a check valve to permit the flow of pressurized fluid through said restriction to flow in only one direction and a second flow path having a restriction therein and a check valve which permits fluid to flow through said second flow path in only a second opposite direction from the fluid flowing through said first flow path.

* * * * *